US006273039B1

(12) United States Patent
Church

(10) Patent No.: US 6,273,039 B1
(45) Date of Patent: Aug. 14, 2001

(54) VALVE DEACTIVATING ROLLER FOLLOWING

(75) Inventor: Kynan L. Church, Ceresco, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/507,590

(22) Filed: Feb. 21, 2000

(51) Int. Cl.[7] ..... F01L 13/00; F02D 13/06

(52) U.S. Cl. ..... 123/90.16; 123/90.48; 123/198 F

(58) Field of Search ..... 123/90.15, 90.16, 123/90.48, 90.5, 90.55, 198 F, 90.39, 90.41, 90.42, 90.46

(56) References Cited

U.S. PATENT DOCUMENTS

| | | | | |
|---|---|---|---|---|
| 4,114,643 | | 9/1978 | Aoyama et al. | 137/495 |
| 4,221,199 | * | 9/1980 | Buuck et al. | 123/90.16 |
| 4,256,070 | * | 3/1981 | Mueller | 123/198 F |
| 4,356,799 | * | 11/1982 | Clark | 123/90.65 |
| 4,414,935 | * | 11/1983 | Curtis et al. | 123/198 F |
| 4,607,599 | | 8/1986 | Buente et al. | 123/90.5 |
| 4,711,207 | | 12/1987 | Bonvallet | 123/198 F |
| 4,930,465 | | 6/1990 | Wakeman et al. | 123/90.12 |
| 5,307,769 | | 5/1994 | Meagher et al. | 123/90.5 |
| 5,398,648 | * | 3/1995 | Spath et al. | 123/90.16 |
| 5,746,165 | * | 5/1998 | Speil et al. | 123/90.16 |
| 5,893,344 | * | 4/1999 | Church | 123/90.16 |
| 5,934,232 | * | 8/1999 | Greene et al. | 123/90.16 |

* cited by examiner

*Primary Examiner*—Weilun Lo
(74) *Attorney, Agent, or Firm*—L. J. Kasper

(57) ABSTRACT

A valve deactivator assembly (49*a*) for an internal combustion engine of the type having valve means (29), drive means (13) for providing cyclical motion for opening and closing the valve means (29) in timed relationship to the events in a combustion chamber (30), and valve gear (21,23) operative in response to the cyclical motion to effect cyclical opening and closing of the valves (29). The valve deactivator assembly (49*a*) comprises part of the valve gear (21,23) and is disposed in series relationship between the drive means (13) and said valves (29). The valve deactivator assembly (49*a*) includes an outer body member (53) disposed for engagement with the drive means (13) and for cyclical motion therewith. There is an inner body member (61) disposed within the outer body member (53) and reciprocable relative thereto, the inner body member (61) having an upper end portion (93) disposed external to the outer body member (53) when the members (53,61) are in a latched condition. A movable latch member (97) is operably associated with the upper end portion (93) of the inner body member (61), the latch member (97) being movable between a latched condition (FIG. 1), operable to transmit the cyclic motion, and an unlatched condition (FIG. 2), operable to permit lost motion between the drive means (13) and the valve means (29).

20 Claims, 4 Drawing Sheets

VALVE DEACTIVATING ROLLER FOLLOWING

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an improved valve train for an internal combustion engine, and more particularly, to a valve deactivator assembly for use therein.

Although the valve deactivator assembly of the present invention may be utilized to introduce some additional lash into the valve train, such that the valves open and close by an amount less than normal, the invention is especially suited for introducing into the valve train sufficient lash (also referred hereinafter as "lost motion"), such that the valves no longer open and close at all, and the invention will be described in connection therewith.

Valve deactivators of the general type to which the invention relates are known, especially in connection with internal combustion engines having push rod type valve train in which there is a rocker arm, with one end of the rocker arm engaging a push rod, and the other end engaging the engine poppet valve. Typically, a central portion of the rocker arm is fixed relative to the cylinder head (or other suitable structure) by a fulcrum arrangement, as is well known to those skilled in the art, in which the fulcrum normally prevents movement of the central portion of the rocker arm in an "up and down" direction, while permitting the rocker arm to engage in cyclical, pivotal movement, in response to the cyclical motion of the push rod, which results from the engagement of the push rod with the lobes of the rotating camshaft.

Examples of known valve deactivator assemblies are shown and described in U.S. Pat. Nos. 4,221,199; 4,256,070; 4,305,356; and 4,380,219, all of which are assigned to the assignee of the present invention, and incorporated herein by reference. The valve deactivators of the above incorporated patents have typically involved some sort of latch member which is movable (typically, rotatable, but in some cases, movable linearly) between a latched position and an unlatched position. The movement of the latch member conventionally occurs is response to linear movement of a linear actuator, by means of an appropriate linkage arrangement.

Although the prior art valve deactivators have operated in a generally satisfactory manner, the actuator arrangement, including the required linkage, has resulted in an unacceptably slow response time, thus limiting the ability of the arrangement to be operated by the engine microprocessor, in synchronism with various other engine systems. The prior art devices typically had a response time, from "ON" to "OFF", or vice versa, in the range of about 100 to 200 milliseconds In modern internal combustion engines, utilizing fuel injection, it is especially desirable in a valve deactivator system to turn off the fuel injectors at the same time that the operation of the valves is stopped. However, the fuel injectors are electrically actuated, and can be turned off almost instantaneously, and therefore, it is desirable to be able to activate the valves and turn on the fuel injectors, or deactivate the valves and turn off the fuel injectors, within the ensuing, single revolution of the engine camshaft. Thus, and by way of example only, in developing the present invention, the goal for the valve deactivator system was a maximum time of less than 25 milliseconds from "ON" to "OFF", or vice versa.

The actuator and linkage arrangements used in the prior art devices have resulted in an excessive number of parts, increasing the overall cost of the system. Finally, the actuator and linkage arrangements have typically taken up enough space to limit the packaging options in the engine cylinder head. This has been especially true in the valve deactivator arrangements of the type shown in the above-incorporated patents wherein the deactivator mechanism comprises part of the fulcrum arrangement of the rocker arm. In a conventional "center-pivot" rocker arm for use with a push rod arrangement, the fulcrum arrangement would typically be disposed entirely within the profile of the rocker arm. However, adding a valve deactivator mechanism to the fulcrum arrangement would cause the fulcrum arrangement to extend substantially above the profile of the rocker arm, thus substantially altering the overall configuration of the cylinder head.

BRIEF SUMMARY OF THE INVENTION

Accordingly, it is an object of the present invention to provide an improved valve deactivator assembly which overcomes the above-described disadvantages of the prior art.

It is a more specific object of the present invention to provide an improved valve deactivator assembly, especially suited for push rod type valve gear, wherein the valve deactivator does not comprise part of the fulcrum arrangement for the rocker arm, which would substantially increase the overall size of the fulcrum arrangement.

It is a related object of the present invention to provide an improved valve deactivator system wherein the valve deactivator mechanism comprises part of an hydraulic roller follower, which is in engagement with the cam profile.

The above and other objects of the invention are accomplished by the provision of a valve deactivator assembly for an internal combustion engine of the type having valve means for controlling the flow to and from a combustion chamber and drive means for providing cyclical motion for opening and closing the valve means in timed relationship to the events in the combustion chamber. Valve gear means is operative in response to the cyclic motion to effect cyclic opening and closing of the valve means. The valve deactivator assembly comprises part of the valve gear means and is disposed in series relationship between the drive means and the valve means.

The valve deactivator assembly is characterized by an outer body member disposed for engagement with the drive means and for cyclical motion therewith. An inner body member is disposed within the outer body member and reciprocable relative thereto, the inner body member having an upper end portion disposed external to the outer body member when the members are in a latched condition. A moveable latch member is operably associated with the upper end portion of the inner body member, the latch member being moveable between a latched condition operable to transmit the cyclic motion, and an unlatched condition, operable to permit lost motion between the drive means and the valve means.

DETAILED DESCRIPTION OF THE PREFERRED EMBODIMENT

Figure 1:
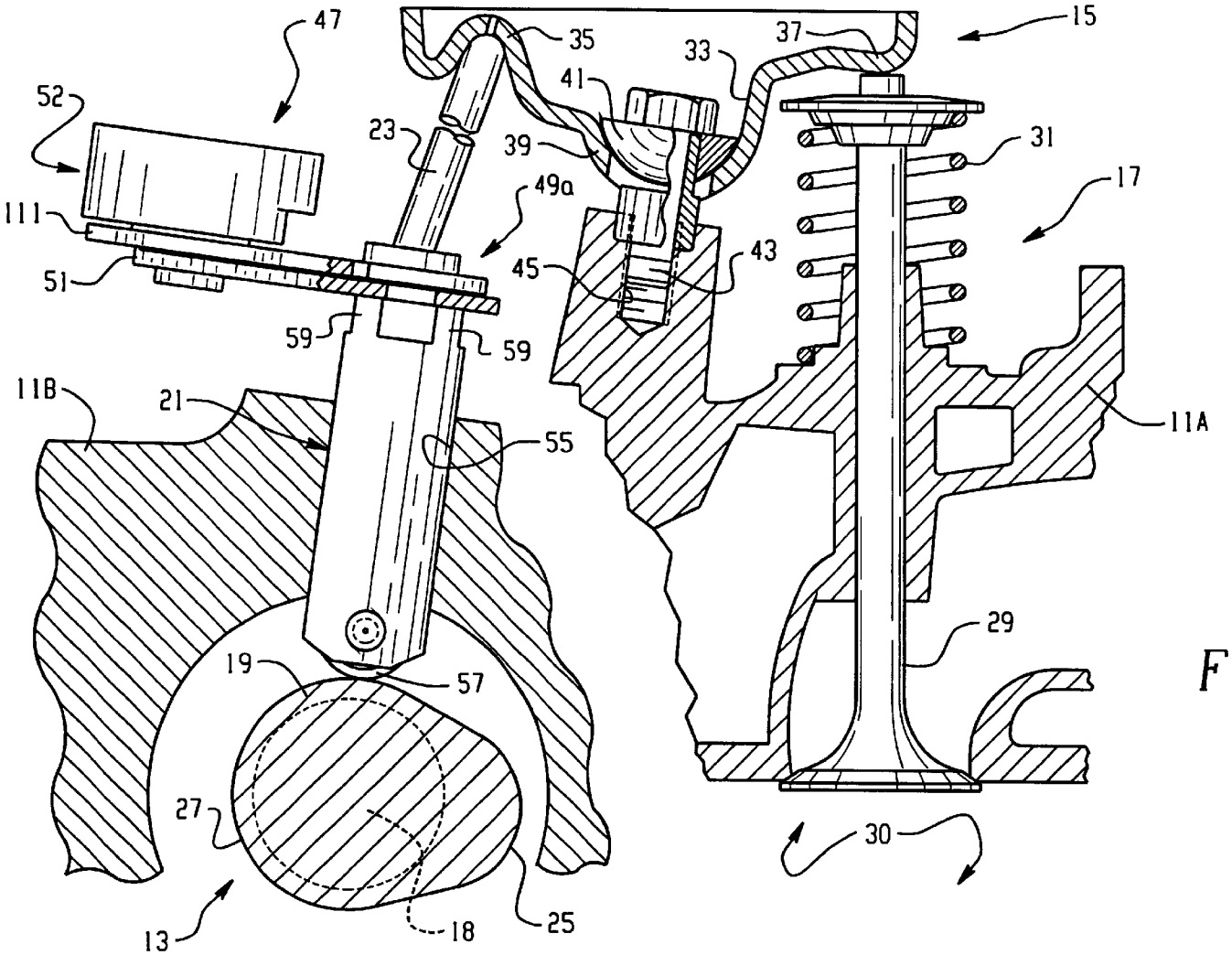
FIG. 1 is a fragmentary, axial cross-section taken through the cylinder head of a vehicle internal combustion engine, illustrating the valve deactivator mechanism of the present invention in external plan view.

Referring now to the drawings, which are not intended to limit the invention, FIG. 1 illustrates a valve actuating drive train of the push rod type, although it should be understood that the use of the present invention is not so limited. FIG. 1 illustrates a cylinder head 11 on which are mounted a drive assembly 13, a rocker arm assembly 15, and an engine poppet valve assembly, generally designated 17.

The drive assembly 13 includes a camshaft 18 having a cam 19, a hydraulic roller follower 21, and a push rod 23 (shown "broken" for ease of illustration). The cam 19 includes a lift portion 25 and a dwell (base circle) portion 27. The poppet valve assembly 17 includes a poppet valve 29, operable to control flow to and from a combustion chamber 30, and a spring 31 which biases the poppet valve 29 toward the closed position shown in FIG. 1, as is well known to those skilled in the art.

The rocker arm assembly 15 includes a rocker arm 33 of the center-pivot type, the rocker arm 33 including one end 35 which is adapted to receive cyclic input motion from the push rod 23, and another end 37 which is adapted to transmit to the valve 29 the cyclic motion of the push rod 23. As a result, the engine poppet valve 29 has a cyclic opening and closing motion, corresponding to that of the push rod 23, all of which is well known to those skilled in the art. In the subject embodiment, the only motion of the rocker arm 33 is its pivotal movement, with the ends 35 and 37 engaging in alternating up and down movement.

The rocker arm 33 includes a pivot portion 39, disposed intermediate the ends 35 and 37, and a fulcrum 41 is disposed within the pivot portion 39 in a manner which permits the rocker arm 33 to pivot as described previously. The fulcrum 41 has a threaded mounting bolt 43 extending therethrough and being in threaded engagement with an internally threaded bore 45 defined by the cylinder head 11.

Typically, the present invention would be utilized with an eight cylinder engine, for which the valve drive train would include four pairs of intake and exhaust valve rocker arms, each equipped with a valve deactivator assembly, generally designated 47. In other words, four of the eight cylinders can be selectively deactivated by introducing sufficient "lost motion" into the valve drive train for that particular valve, so that the cyclic motion of the push rod 23 does not result in any corresponding cyclic opening and closing movement of the poppet valve 29 (i.e., of either the intake valve or exhaust valve for that particular cylinder). More specifically, the lost motion is introduced into the drive train at the hydraulic roller follower 21, which, in the subject embodiment, actually comprises part of the valve deactivator assembly 47, as will be described further subsequently. Although not an essential feature of the invention, it is preferred that the valve deactivator assembly 47 operate by permitting lost motion between the cam 19 and the rocker arm 33, such that cyclic motion of the push rod 23 does not result in any pivotal movement of the rocker arm about its pivot portion 39.

In accordance with one important aspect of the present invention, the preferred embodiment of the valve deactivator assembly 47 comprises an assembly of a pair of valve deactivators, 49*a* and 49*b*, which are operatively associated with a pair of poppet valves 29 wherein, typically, and as discussed above, one of the valves would be an intake valve and the other would be an exhaust valve, such that both the intake and exhaust functions are "deactivated". The valve deactivators 49*a* and 49*b* would typically be identical, such that only the deactivator 49*a* will be described hereinafter.

Figure 2:
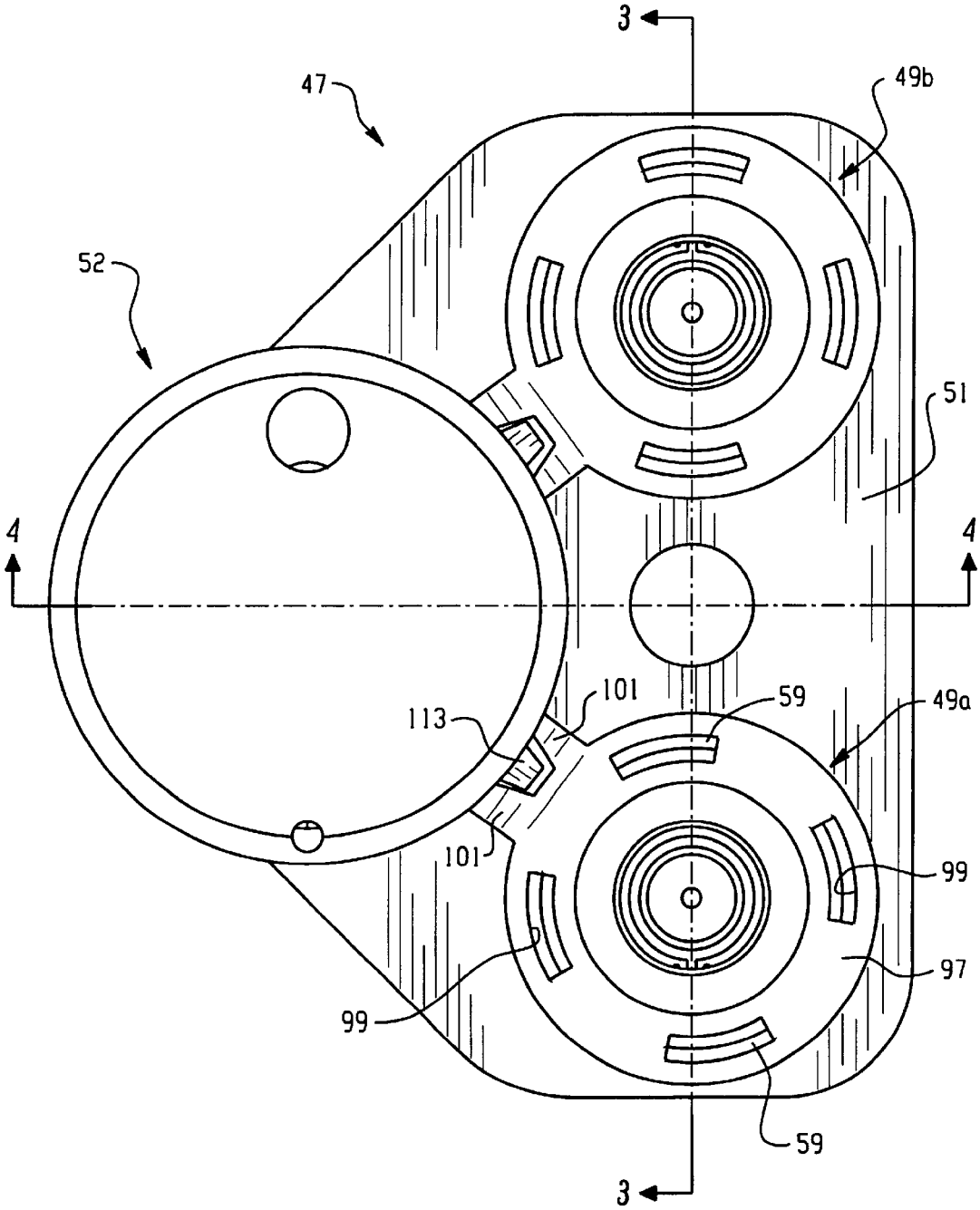
FIG. 2 is a somewhat enlarged, top plan view showing only the valve deactivator mechanism of the present invention.

In connection with the further description of the present invention, those skilled in the art will understand that where spatial terms such as "above" and "below", and terms of similar import, are used to specify general relationships between parts, they are not necessarily intended to indicate orientation of the parts within a vehicle engine. Referring now to FIG. 2, in conjunction with FIG. 1, the valve deactivator assembly 47 includes a generally triangular mounting plate 51, which would typically be fixed relative to the cylinder head 11. Fixed to the mounting plate 51 is an electromagnetic actuator 52 which will be described in greater detail subsequently.

Figure 3:
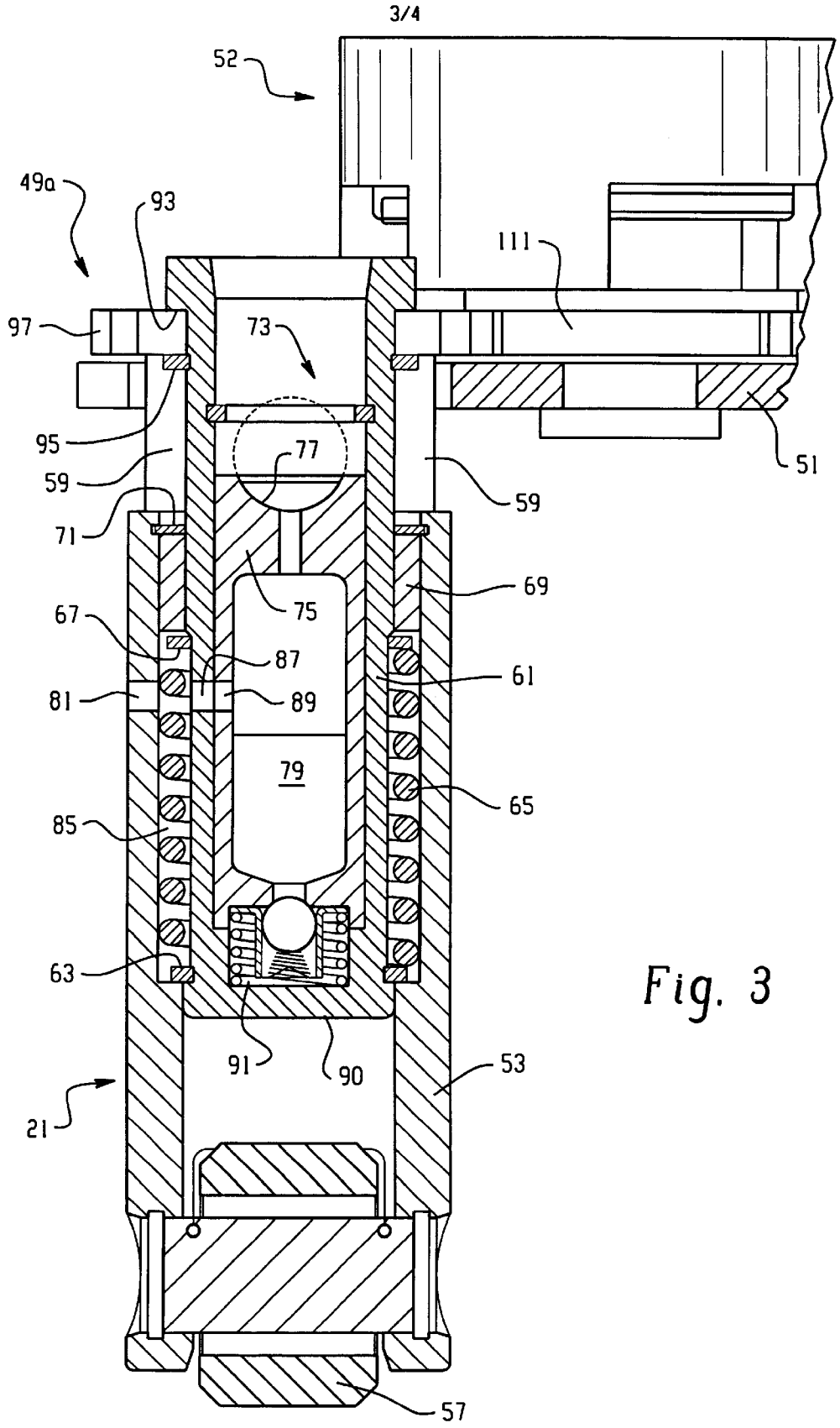
FIG. 3 is an enlarged, fragmentary, transverse cross-section, taken generally on line 3—3 of FIG. 2, but showing only a single valve deactivator for ease of illustration.

Referring now primarily to FIG. 3, an individual valve deactivator 49*a* will be described, it being noted that the lower portion thereof was identified in FIG. 1 as comprising a hydraulic roller follower 21. An example of a conventional hydraulic roller follower, not having valve deactivator capability, is illustrated and described in U.S. Pat. No. 4,607,599, assigned to the assignee of the present invention and incorporated herein by reference. The valve deactivator 49*a* includes an outer body member 53 which is disposed to reciprocate within a bore 55 (see FIG. 1) in the cylinder head 11. The body member 53 is in contact with, and follows the cam 19 through a conventional roller follower 57, shown herein as being of the needle roller bearing type. At the upper end of the outer body member 53 is a plurality of crenellations 59 of the type which are generally well known to those skilled in the art from the above-incorporated patents. The function of the crenallations 59 will be described in greater detail subsequently.

Disposed within the outer body member 53 is an inner body member 61. Toward the lower end in FIG. 3 the inner body member 61 is surrounded by a stop clip 63 which serves as the lower spring seat for a lost motion compression spring 65. At its upper end, the spring 65 is seated against another stop clip 67, which engages a shoulder on the outer periphery of the inner body member 61. Above the stop clip 67, and disposed radially between the inner surface of the outer body member 53 and the outer surface of the inner body member 61 is a pilot ring 69, having its upper end seated against a snap ring 71.

Disposed within the inner body member 61 is a hydraulic lash compensation element, generally designated 73, of the general type which is now well known to those skilled in the art, and which will not be described in great detail herein. The lash compensation element 73 includes a plunger member 75 defining a socket surface 77, adapted for engagement with the push rod 23, in a manner also well known to those skilled in the art. The lash compensation element 75 defines a fluid reservoir 79 which receives pressurized engine oil by means of a fluid port 81, defined by the outer body member 53 being in fluid communication with an engine oil passage (not shown herein) formed in the cylinder head 11. Such pressurized fluid fills a chamber 85 formed between the outer body member 53 and the inner body member 61. From the chamber 85, fluid flows through a fluid port 87 formed in the cylindrical wall of the inner body member 61, then through a fluid port 89 formed in the lash compensation element 73, then enters the fluid reservoir 79. Disposed between a bottom end wall 90 of the inner body member 61 and the lash compensation element 73 is a high pressure chamber 91, the function of which is to contain fluid under substantial pressure during a valve event, thus providing some rigidity within the valve gear train, but also providing the capability of compensating for lash as is well known to those skilled in the lash compensation art.

Referring now to FIG. 3, in conjunction with FIG. 2, the upper end of the inner body member 61 is enlarged and defines a shoulder surface 93. Spaced axially below the surface 93 is a snap ring 95, and disposed axially between the surface 93 and the snap ring 95 is an annular latch member 97. As may best be seen in FIG. 2, the latch member 97 defines a plurality of arcuate openings 99, there being four of the openings 99 uniformly spaced, circumferentially, in FIG. 2. The latch member 97 also includes a pair of teeth 101, the function of which will be described subsequently. As may best be seen in FIG. 2, in which the valve deactivator 49*a* is in its unlatched condition, the crenellations 59 are aligned, circumferentially, with the arcuate openings 99.

Figure 4:
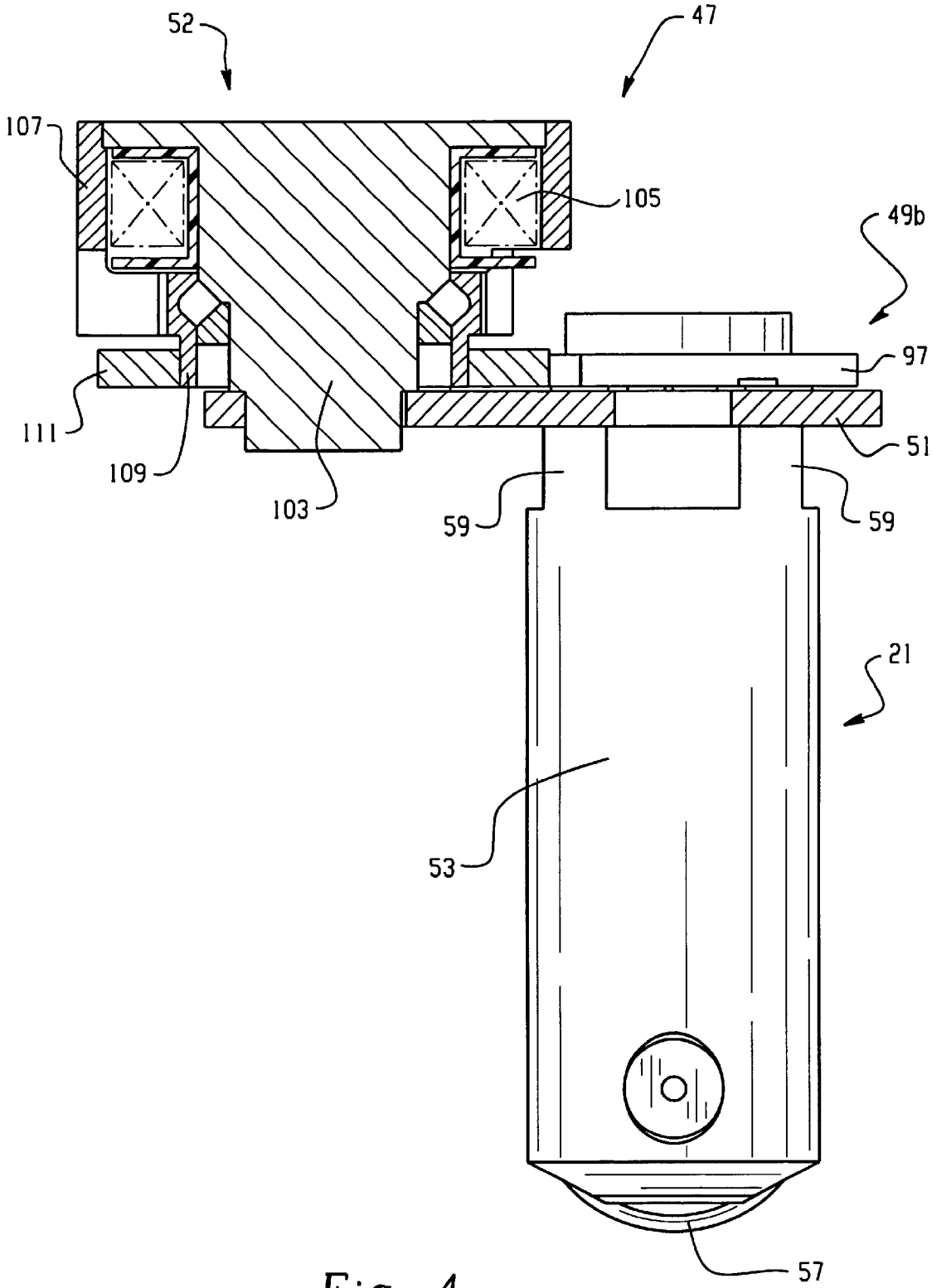
FIG. 4 is a transverse cross-section taken on line 4—4 of FIG. 2, and on the same scale as FIG. 2.

Referring now primarily to FIG. 4, the electromagnetic actuator 52 includes a stepped, generally cylindrical support member 103, which is preferably fixed relative to the mounting plate 51. Surrounding the support member 103, toward the upper end thereof, is an annular electromagnetic coil 105 which, in turn, is surrounded by an outer, stationary pole piece 107. Disposed beneath the coil 105 is a rotatable armature 109, and extending radially outward from the armature 109 is an actuating ring 111. The actuating ring 111 includes a tooth 113 (seen only in FIG. 2), the tooth 113 being in engagement with the teeth 101 of the annular latch member 97. Thus, when it is desired to operate the valve deactivators in the unlatched condition, an appropriate electrical signal is transmitted to the coil 105, and the resulting electromagnetic field in the support member 103 and stationary pole piece 107 rotates the armature 109, as well as the actuating ring 111, which in turn rotates the latch member 97 toward its unlatched position shown in FIG. 2, from the latched position.

It should be noted that, preferably, the logic controlling the signal to the actuator 52 operates such that the change in condition, from latched to unlatched, or vice versa, occurs while the follower 57 is in contact with the base circle portion 27 of the cam 19. As is well known to those skilled in the art, it would be difficult to change the condition of the valve deactivator 49*a* with the follower 57 on the lift portion 25 of the cam because of the additional loading to which the deactivator is subjected. Also, it is clearly more desirable to make any change in the condition of the deactivator before the start of the next "valve event", as that term is understood.

In the unlatched condition shown in FIG. 2, in which the actuator 52 is energized, as the cam 19 rotates clockwise from the position shown in FIG. 1, such that the lift portion 25 engages the follower 57, the result is upward movement of the roller follower 21 (i.e., upward movement of the outer body member 53). However, in the unlatched condition, with the crenellations 59 aligned with the openings 99, the upward movement of the outer body member 53 merely results in the crenellations 59 projecting upward through the openings 99. Thus, there is "lost motion" of the body member 53 in the sense that the body member 53 moves upward, but with no corresponding upward movement of the inner body member 61 occurring, and therefore, no corresponding upward movement of the lash compensation element 73 or of the push rod 23. Although the upward movement of the outer body member 53 will exert an upward biasing force on the inner body member 61, by means of the lost motion spring 65, the biasing force of the poppet valve spring 31 is selected to be greater than that of the lost motion spring 65, and no corresponding upward movement of the inner body member 61 occurs. As a result, the associated valve is deactivated when the valve deactivator 49*a* is unlatched.

It should be noted that, as the outer body member 53 moves upward in the unlatched condition, the pilot ring 69 moves upward with the member 53, such that the volume of the chamber 85 doesn't change. As a result, there are no undesirable pressure pulses created, as would occur if the volume of the chamber 85 varied during reciprocation of the member 53. Those skilled in the art will understand that any such undesired pressure pulses would possibly impact the proper operation of the other valve gear elements, such as the lash compensation elements associated with valves which are not then being deactivated.

When it is again desired to operate this set of valves 29 in the normal manner, instead of in the deactivated mode, the signal to the electromagnetic actuator 52 is discontinued, thus permitting the latch member 97 to rotate from the unlatched position shown in FIG. 2 toward the latched position, under the influence of a biasing (return) spring (not shown herein) in the actuator 52. As the latch members 97 rotate to the latched position, they rotate about 20 to 25 degrees from the position shown in FIG. 2, such that each of the crenellations 59, instead of being aligned with an opening 99, is disposed between two adjacent openings 99. It is important to understand that when the follower 57 is engaging the base circle portion 27, the upper surface of each of the crenellations 59 is spaced slightly downward from the underside of the latch member 97. As a result, there is no substantial resistance to rotation of the latch member 97 during a change in the condition of the valve deactivator, either to or from the latched condition.

As soon as the cam 19 rotates enough, the follower 57 leaves the base circle portion 27 and engages the lift portion 25, biasing the outer body member 53 upward until the upper surfaces of the crenellations 59 engage the underside of the latch member 97. Thereafter, up and down movement of the outer body member 53 results in corresponding up and down movement of both the inner body member 61 and the lash compensation element 75, thus also moving the push rod 23 in its normal cyclical up and down motion to open and close the valve 29. Therefore, FIGS. 1 and 4 could be considered to represent the latched condition of the deactivators 49*a* and 49*b*, respectively. By way of example only, as the cam 19 rotates, the vertical movement of the deactivator 49*a* is about 8.5 mm, resulting in a vertical movement of the valve 29 of about 14 mm in going between closed (FIG. 1) and fully open.

As the valve deactivator 49*a* operates in its latched condition, and the inner body member moves up and down in FIGS. 1, 3, and 4, the latch member 97 moves up and down with the member 61. However, the actuating ring 111 is fixed to the armature 109, and has no movement in the vertical direction. Therefore, it is one important aspect of the present invention that the mesh of the teeth 101 and 113 permits upward and downward movement of the latch member 97, relative to the actuating ring 111, although it should be understood that the invention is not so limited, and various other means could be used to transmit rotational motion, while permitting relative vertical movement.

Although the subject embodiment of the invention includes a rotary type actuator 52, it should be understood that such is not an essential feature of the invention, nor is the use of rotating latch members 97. For example, either the actuator and/or the latch members could operate linearly, within the scope of the invention. However, the use herein of both the rotary latch member 97 and the rotary actuator 52 results in an optimum assembly in regard to the small size and the absence of complicated and expensive linkage members. Preferably, the electromagnetic actuator 52 could be made in accordance with the teachings of co-pending application U.S. Ser. No. 09/114,739, filed Jul. 13, 1998 in the name of Kynan L. Church for a "VALVE DEACTIVATOR FOR PEDESTAL TYPE ROCKER ARM".

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve deactivator assembly for an internal combustion engine of the type having valve means for controlling the flow to and from a combustion chamber, drive means for providing cyclical motion for opening and closing said valve means in timed relationship to the events in said combustion chamber, and valve gear means operative in response to said cyclical motion to effect cyclical opening and closing of said valve means; said valve deactivator assembly comprising part of said valve gear means and being disposed in series relationship between said drive means and said valve means; said valve deactivator assembly characterized by:

(a) an outer body member disposed for engagement with said drive means and for said cyclical motion therewith;

(b) an inner body member disposed within said outer body member and reciprocable relative thereto, said inner body member having an upper end portion, all of said upper end portion being disposed external to said outer body member when said members are in a latched condition;

(c) a movable latch member operably engageable with said upper end portion of said inner body member, said latch member being movable between a latched condition, operable to transmit said cyclic motion, and an unlatched condition, operable to permit lost motion between said drive means and said valve means.

2. A valve deactivator assembly as claimed in claim 1, characterized by said drive means comprises a camshaft having a cam defining a base circle portion and a lift portion.

3. A valve deactivator assembly as claimed in claim 2, characterized by said valve gear means comprises a rocker arm in operable engagement with said valve means, and a push rod in operable engagement with said rocker arm.

4. A valve deactivator assembly as claimed in claim 3, characterized by said inner body member including means defining a socket surface adapted for engagement with said push rod.

5. A valve deactivator assembly as claimed in claim 4, characterized by said means defining said socket surface comprises a hydraulic lash compensation assembly reciprocably disposed within said inner body member.

6. A valve deactivator assembly as claimed in claim 2, characterized by said outer body member including a roller type cam follower adapted for engagement with said base circle portion and said lift portion of said cam as said camshaft rotates.

7. A valve deactivator assembly as claimed in claim 1, characterized by said engine including a cylinder head defining a bore disposed adjacent said drive means, said outer body member of said valve deactivator assembly being generally cylindrical and adapted for reciprocation within said bore.

8. A valve deactivator assembly as claimed in claim 1, characterized by said outer body member being generally cylindrical and hollow, and said inner body member being generally cylindrical and hollow, said outer and inner body members defining therebetween a generally annular chamber.

9. A valve deactivator assembly as claimed in claim 8, characterized by a coil spring being disposed within said annular chamber, said spring having an upper end seated relative to said inner body member, and a lower end seated relative to said outer body member, whereby said spring biases said members toward an extended position, relative to each other.

10. A valve deactivator assembly as claimed in claim 8, characterized by said outer body member defining a first fluid port adapted for communication with a source of pressurized fluid, said first fluid port being in relatively unrestricted fluid communication with said generally annular chamber.

11. A valve deactivator assembly as claimed in claim 10, characterized by said inner body member defining a second fluid port, in relatively unrestricted fluid communication with said generally annular chamber, said second fluid port communicating pressurized fluid to a hydraulic lash compensation assembly reciprocably disposed within said inner body member.

12. A valve deactivator assembly as claimed in claim 11, characterized by an annular pilot member disposed radially between an inner surface of said outer body member and an outer surface of said inner body member, said inner and outer body members and said pilot member cooperating to define said generally annular chamber, said inner surface and said outer surface being configured such that reciprocation between said inner and outer body members results in no substantial change in the fluid volume of said annular chamber.

13. A valve deactivator assembly as claimed in claim 1, characterized by said movable latch member is generally annular and is disposed in a surrounding relationship relative to said upper end portion of said inner body member, said latched and unlatched conditions comprising two rotatably displaced positions of said latch member.

14. A valve deactivator assembly as claimed in claim 13, characterized by an electromagnetic actuator operably associated with said latch member, and having a de-energized condition, corresponding to one of said latched and unlatched conditions, and an energized condition, corresponding to the other of said latched and unlatched conditions.

15. A valve deactivator assembly for an internal combustion engine of the type having an intake valve and an exhaust valve, drive means for providing cyclical motion for opening and closing said valves in timed relationship to the events in a combustion chamber, and valve gear means operative in response to said cyclic motion to effect cyclic opening and closing of said valves; said valve deactivator assembly comprising part of said valve gear means and including first and second valve deactivators disposed in series relationship between said drive means and said intake and exhaust valves, respectively, said valve deactivator assembly characterized by:

(a) each of said first and second valve deactivators comprising an outer body member disposed for engagement with said drive means and for said cyclical motion therewith;

(b) said outer body member comprising a plurality of crenellations;

(c) each of said first and second valve deactivators comprising a rotatable latch member operably associated with said crenellations, said latch member being rotatable between a latched condition operable to transmit said cyclic motion, and an unlatched condition, operable to permit lost motion between said drive means and the respective valve; and (d) said assembly further comprising an electromagnetic actuator disposed adjacent said first and second valve deactivators and including a rotary output member operably associated with both of said latch members of said first and second valve deactivators, whereby rotation of said rotary output member rotates both of said latch members, in unison, between said latched and unlatched conditions.

16. A valve deactivator assembly as claimed in claim 15, characterized by said electromagnetic actuator being fixed relative to a mounting plate, and each of said latch members lying in a plane above said mounting plate, said rotary output member lying in said plane, and being rotatable relative to said mounting plate.

17. A valve deactivator assembly as claimed in claim 16, characterized by each of said first and second valve deactivators including an inner body member disposed within said outer body member and reciprocable relative thereto, said inner body member having an upper end portion extending upwardly through said mounting plate, and being surrounded by said latch member.

18. A valve deactivator assembly as claimed in claim 17, characterized by said latch member being fixed axially relative to said upper end portion of said inner body member; said rotary output member of said electromagnetic actuator being fixed axially relative to said mounting plate, and being in toothed engagement with said latch members whereby said inner body members may reciprocate axially in response to said cyclic motion, relative to said rotary output member.

19. A valve deactivator assembly as claimed in claim 18, characterized by each of said inner body members including means defining a socket surface adapted for engagement with a push rod, and said drive means comprises a camshaft having a cam defining a base circle portion and a lift portion.

20. A valve deactivator assembly as claimed in claim 19, characterized by said means defining said socket surface comprises a hydraulic lash compensation assembly reciprocably disposed within each of said inner body members.

* * * * *